US006719543B2

(12) United States Patent
Gentile et al.

(10) Patent No.: US 6,719,543 B2
(45) Date of Patent: Apr. 13, 2004

(54) SELECTIVELY ADJUSTABLE FIXED DISPLACEMENT VANE PUMP

(75) Inventors: Anthony J. Gentile, Watertown, CT (US); Frank M. Amazeen, West Hartford, CT (US); William H. Dalton, Amston, CT (US)

(73) Assignee: Coltec Industires Inc, Charlotte, NC (US)

( * ) Notice: Subject to any disclaimer, the term of this patent is extended or adjusted under 35 U.S.C. 154(b) by 89 days.

(21) Appl. No.: 10/086,189

(22) Filed: Feb. 27, 2002

(65) Prior Publication Data

US 2002/0119060 A1 Aug. 29, 2002

Related U.S. Application Data

(60) Provisional application No. 60/271,886, filed on Feb. 27, 2001.

(51) Int. Cl.[7] ..... F04C 2/344; F04C 15/04
(52) U.S. Cl. ..... 418/30
(58) Field of Search ..... 418/30, 31

(56) References Cited

U.S. PATENT DOCUMENTS

| | | | | | |
|---|---|---|---|---|---|
| 1,728,321 | A | * | 9/1929 | Antonelli | 418/30 |
| 1,819,689 | A | * | 8/1931 | Ott | 418/30 |
| 2,362,420 | A | * | 11/1944 | Tucker et al. | 418/31 |
| 2,493,525 | A | * | 1/1950 | Bush | 418/30 |
| 2,513,447 | A | | 7/1950 | Brown | 418/30 |
| 2,988,003 | A | * | 6/1961 | Schmied | 418/31 |
| 3,361,076 | A | * | 1/1968 | Davis | 418/31 |
| 3,402,891 | A | * | 9/1968 | Clark et al. | 418/31 |
| 3,415,058 | A | | 12/1968 | Underwood et al. | 418/30 |
| 4,030,861 | A | * | 6/1977 | Putz | 418/31 |
| 4,325,215 | A | * | 4/1982 | Yamamoto | 418/31 |
| 5,690,479 | A | | 11/1997 | Lehmann et al. | 418/30 |

FOREIGN PATENT DOCUMENTS

| | | |
|---|---|---|
| DE | 4428 410 A1 | 2/1996 |
| GB | 1186360 | 4/1970 |

OTHER PUBLICATIONS

U.S. patent application Ser. No. 239,352, Sturm, filed May, 1943.*

* cited by examiner

*Primary Examiner*—John J. Vrablik
(74) *Attorney, Agent, or Firm*—Scott D. Wofsy; Edwards & Angell, LLP

(57) ABSTRACT

An adjustable fixed displacement vane pump is disclosed which includes a pump housing defining an interior pumping chamber having a central axis extending therethrough, a rotor member mounted for rotational movement within the interior pumping chamber of the pump housing about an axis aligned with the central axis of the interior pumping chamber, the rotor member having a central vane section with a plurality of circumferentially spaced apart radial vane slots formed therein, each vane slot supporting a corresponding vane element mounted for radial movement therein, and each vane element having an outer tip surface, a cam member mounted for pivotal movement within the interior pumping chamber of the pump housing about a fulcrum axis extending parallel to the central axis of the rotor member, the cam member defining a cam body having a circular bore extending therethrough for receiving the rotor member, the circular bore forming a cam chamber defining a cam surface making continuous contact with the outer tip surfaces of the vane elements during the rotation of the rotor member; and structure for selectively maintaining the cam member in a fixed position relative to the axis of the rotor member.

3 Claims, 3 Drawing Sheets

Fig. 3
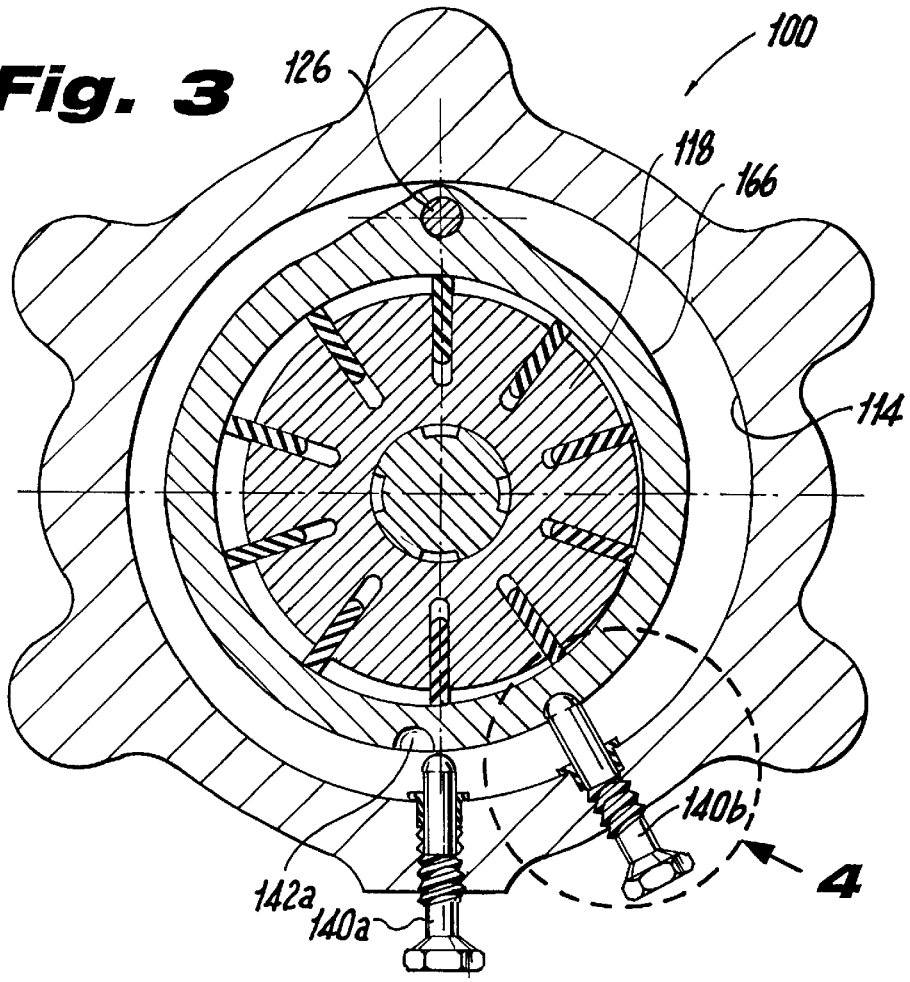
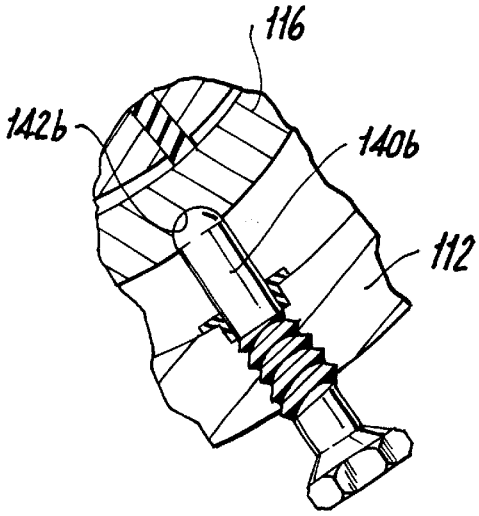
Fig. 4
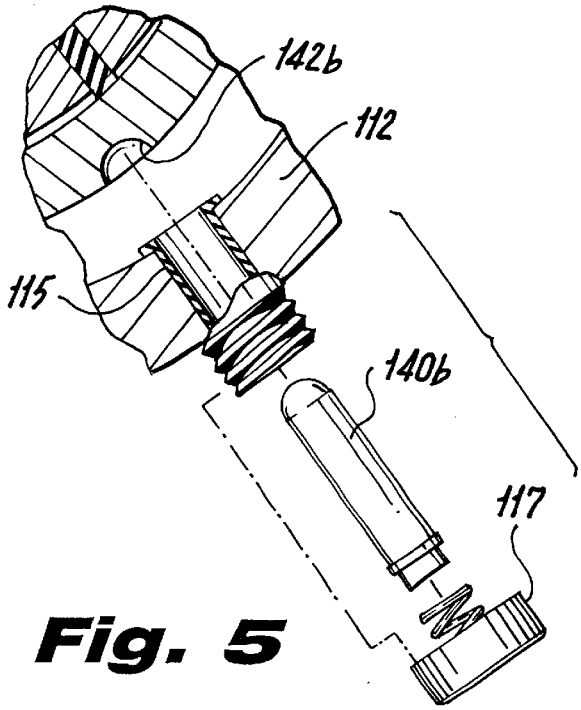
Fig. 5

SELECTIVELY ADJUSTABLE FIXED DISPLACEMENT VANE PUMP

CROSS-REFERENCE TO RELATED APPLICATION

The subject application claims the benefit of priority from U.S. Provisional Patent Application Ser. No. 60/271,886 filed Feb. 27, 2001, the disclosure of which is herein incorporated by reference in its entirety.

BACKGROUND OF THE INVENTION

1. Field of the Invention

The subject invention relates to fuel metering systems, and more particularly, to a fixed displacement vane pump for use in aircraft engines that is adapted and configured to be selectively adjusted to accommodate a range of different engine applications.

2. Background of the Related Art

For many years, main engine fuel pumps for aircraft had been configured as fixed displacement gear pumps. Fixed displacement vane pumps were developed in order to overcome certain deficiencies of gear pumps. An example of a fixed displacement vane pump is disclosed in U.S. Pat. No. 4,354,809, the disclosure of which is herein incorporated by reference in its entirety.

Vane pumps include a rotor element that has radial slots for supporting radially movable vane elements defining circumferential vane buckets. The rotor element is mounted within a cam member defining an interior cam surface. The outer tips of the vane elements are in continuous contact with the interior cam surface of the cam member. The cam surface has a fluid inlet port through which fluid is delivered to the low pressure inlet areas of the rotor surface. The fluid is subsequently compressed within the vane buckets and discharged from the high pressure outlet areas of the rotor surface as pressurized fluid.

Variable displacement vane pumps are also well known in the art, as disclosed for example in commonly assigned U.S. Pat. Nos. 5,545,014 and 5,545,018, the disclosures of which are herein incorporated by reference in their entireties. Variable displacement vane pumps have a swing cam element which pivots relative to the rotor element, so as to change the relative volumes of the inlet and outlet discharge areas, and thereby vary the displacement capacity of the pump.

In the aerospace industry, there is a broad range of engine applications that employ fixed displacement vane pumps and variable displacement vane pumps. For each application, the pumping requirements vary, thus requiring different sized pumps. Resizing new pumps for each engine application is costly, particularly in the case of variable displacement vane pumps. It would be beneficial therefore, to provide a fixed displacement vane pump that can be selectively adjusted to accommodate a wide range of different engine applications.

SUMMARY OF THE INVENTION

The subject invention is directed to a low cost fixed displacement vane pump that can be selectively adjusted to accommodate a wide range of different engine applications. The fixed displacement pump of the subject invention includes a pump housing defining an interior pumping chamber having a central axis extending therethrough. A rotor member is mounted for rotational movement within the interior pumping chamber of the pump housing about an axis aligned with the central axis of the interior pumping chamber. The rotor member has a central vane section with a plurality of circumferentially spaced apart radial vane slots formed therein. Each vane slot supports a corresponding vane element mounted for radial movement therein, and each vane element has an outer tip surface.

A cam member is mounted for pivotal movement within the interior pumping chamber of the pump housing about a fulcrum axis extending parallel to the central axis of the rotor member. The cam member defines a cam body having a circular bore extending therethrough for receiving the rotor member. The circular bore forms a cam chamber defining a cam surface making continuous contact with the outer tip surfaces of the vane elements during the rotation of the rotor member.

In addition, means are provided for selectively maintaining the cam member in a fixed position relative to the axis of the rotor member. In one embodiment of the subject invention, the means for selectively maintaining the cam member in a fixed position is preferably in the form of a pair of diametrically opposed locking bolts mounted to bear against an outer circumferential surface of the cam member. In another embodiment of the subject invention, the means for selectively maintaining the cam member in a fixed position is preferably in the form of two or more dowels mounted to engage corresponding ports formed in the outer circumferential surface of the cam member.

The means for selectively maintaining the cam member in a fixed position relative to the axis of the rotor member is adapted and configured to fix the position of the cam member in a position which ranges between a maximum eccentric position relative to the axis of the rotor member and a minimum eccentric position (or nearly concentric position) relative to the axis of the rotor. The maximum eccentric position corresponds to a maximum displacement flow condition for the pump and the minimum eccentric position corresponds to a minimum displacement flow condition for the pump.

These and other unique features of the selectively adjustable fixed displacement vane pump of the subject invention will become more readily apparent from the following description of the drawings taken in conjunction with the description of the preferred embodiment.

BRIEF DESCRIPTION OF THE DRAWINGS

So that those having ordinary skill in the art to which the subject invention appertains will more readily understand how to construct the selectively adjustable fixed displacement vane pump of the subject invention, reference may be had to the drawings wherein:

FIG. 3 is a cross-sectional view of another selectively adjustable fixed displacement vane pump of the subject invention taken along line 2—2 of FIG. 1 which employs a set of dowels mounted to engage corresponding ports formed in an outer circumferential surface of the pivoting cam member;

FIG. 4 is an enlarged localized view of the threaded dowel illustrated in FIG. 3; and FIG. 5 is an alternative embodiment of a dowel configured for use with the selectively adjustable fixed displacement vane pump of FIG. 3 which is spring-loaded.

DESCRIPTION OF THE PREFERRED EMBODIMENTS

Figure 1:
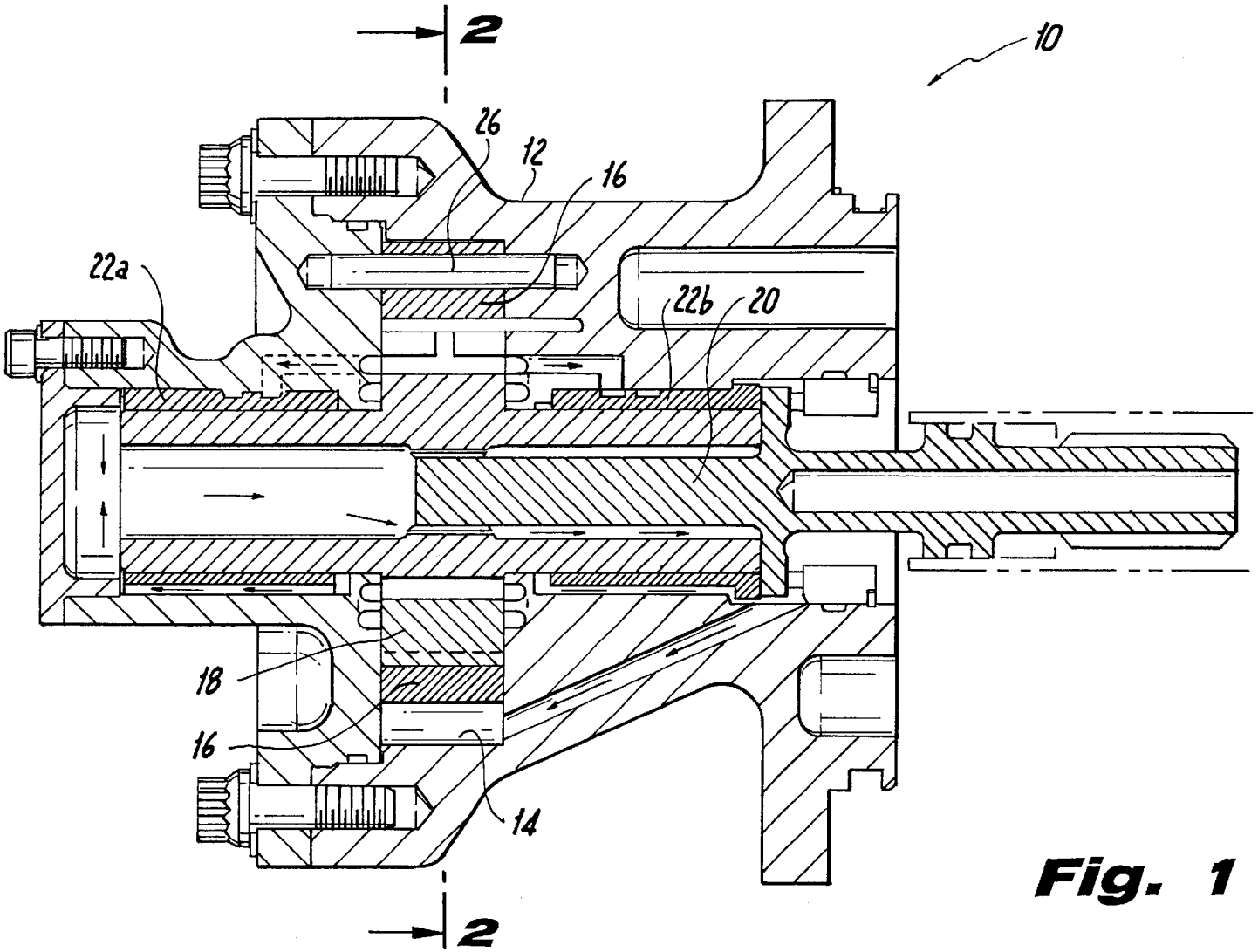
FIG. 1 is side elevational view in cross-section of a selectively adjustable fixed displacement vane pump constructed in accordance with a preferred embodiment of the subject invention.

Referring now to the drawings wherein like reference numerals identify similar structural features of the subject invention, there is illustrated in FIG. 1 a selectively adjustable fixed displacement vane pump constructed in accordance with a preferred embodiment of the subject invention and designated generally by reference numeral 10.

Vane pump 10 includes a pump housing 12 defining inlet and outlet pathways for accommodating the flow of fuel therethrough, as indicated by the directional flow arrows in FIG. 1. Vane pump 10 may be mated to and fed with fuel from a centrifugal boost stage pump (not shown) consisting of an axial inducer and radial impeller, together with an associated collector and diffuser.

Pump housing 12 further defines an interior pumping chamber 14 with inlet and outlet zones supporting a selectively adjustable cam member 16 and a rotor member 18. Rotor member 18 is keyed to a main drive shaft 20 that is rotatably supported within housing 12 by opposed cylindrical bearings 22*a* and 22*b*. Drive shaft 20 extracts power in a conventional manner from the engine with which the pump is associated. A second drive shaft (not shown) may be operatively associated with the main drive shaft 20 to power the boost stage pump.

Figure 2:
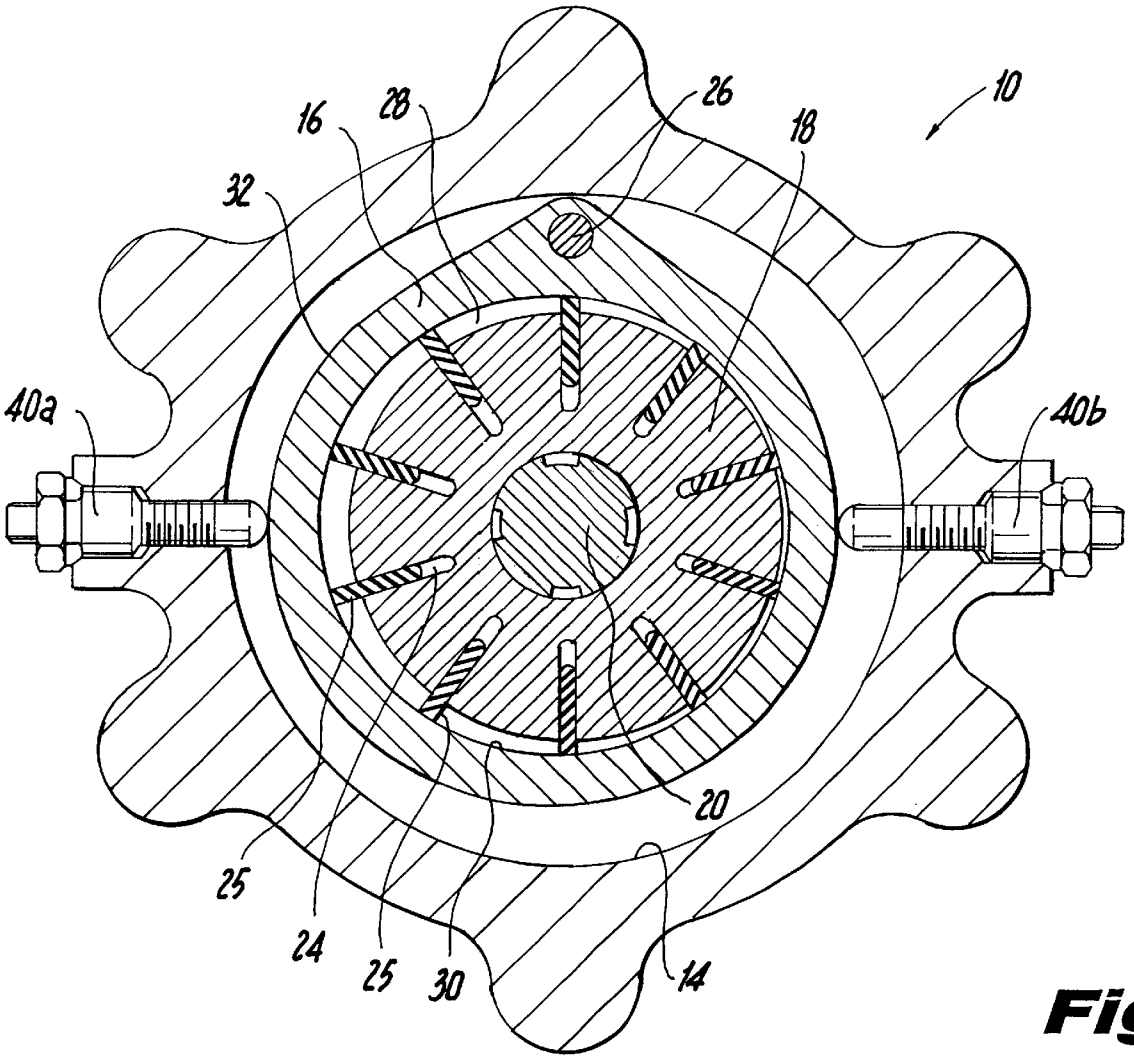
FIG. 2 is a cross-sectional view of the selectively adjustable fixed displacement vane pump of the subject invention taken along line 2—2 of FIG. 1 which employs a pair of diametrically opposed locking bolts mounted to bear against an outer circumferential surface of the pivoting cam member.

Referring to FIG. 2, rotor member 18 includes a plurality of radially extending slots 24, each for slidably supporting a corresponding vane element 25. The vane elements 25 fit snugly within the radial vane slots 24 and function like pistons as they are depressed into the slots during movement of the rotor 18 relative to cam member 16. Cam member 16 is mounted on a pivot pin or fulcrum 26 supported in housing 12 and defines a circular bore 28 forming a cam chamber. The cam chamber defines a cam surface 30 that makes continuous contact with the outer tips of vane elements 25. Preferably, the outer tips of the vane elements 25 are rounded to provide smooth contact with the cam surface 30, thus minimizing contact stress.

Diametrically opposed locking bolts 40*a* and 40*b* are threadably associated with pump housing 12 and include rounded end portions configured to bear against an outer circumferential surface 32 of cam member 16. Locking bolts 40*a* and 40*b* are adapted to react against each other on a common transverse axis to selectively fix the position of the cam member 16 relative to the axis of rotor member 18. Thus, the cam member 16 may be selectively moved about fulcrum 26 to a desired position and locked into place to produce a specific fuel flow for a given pump application.

More specifically, as shown in FIG. 2, when locking bolt 40*a* is in a minimum extended position and locking bolt 40*b* is in a maximum extended position within pumping chamber 14, cam member 16 will reside in a maximum eccentric position, and pump 10 will have a maximum operational displacement. Alternatively, when locking bolts 40*a* and 40*b* are extended to substantially equal distances within pumping chamber 14 (not shown) cam member 16 will be substantially concentric (or minimally eccentric) with the rotor member 18 and pump 10 will have a minimum operational displacement.

In operation, rotation of rotor member 18 within the eccentrically positioned cam member 16 produces a proportional volume displacement of fuel for delivery to the engine. In accordance with the subject invention, by selectively varying the offset position or eccentricity of the cam member 16 relative to the axis of the rotor member 18, the fuel output from the discharge arc of the rotor will vary as in the case of a variable displacement vane pump. Accordingly, the pump is at maximum displacement when the cam member 16 is positioned so that the vane buckets between adjacent vane elements experience maximum contraction in the discharge arc zone of the pump. Likewise, minimum flow occurs when the cam member 16 and the rotor member 18 are nearly concentric with one another. Thus, the fixed displacement pump 10 of the subject invention may be selectively adjusted to accommodate a wide range of different engine applications, each requiring a specific fuel flow or output.

Referring now to FIG. 3, there is illustrated another embodiment of a selectively adjustable fixed displacement vane pump designated generally by reference numeral 100. Vane pump 100 is substantially similar to vane pump 10 in that it includes a cam member 116 pivotably supported on a fulcrum 126 and a rotor member 118 mounted for rotation within the pumping chamber 114 of pump housing 112. However, in this embodiment of the subject invention, at least two dowels are provided to selectively fix the position of the cam member 116 relative to the axis of the rotor member 118, rather than the two diametrically opposed adjustable locking bolts 40*a*, 40*b* of pump 10.

More particularly, threaded dowels 140*a* and 140*b* are adjustably supported within pump housing 112 for cooperating with corresponding dowel ports 142*a* and 142*b* formed in the outer periphery of cam member 116. As illustrated, dowel 140*a* is nearly aligned with (or minimally offset from) the centerline of rotor member 118 for cooperating with dowel port 142*a* to achieve a minimum displacement flow condition for pump 100. Similarly, dowel 140*b* is angularly offset from the centerline of rotor member 118 for cooperating with dowel port 142*b* to achieve a maximum displacement flow condition for pump 100. Preferably, when one of the dowels is employed, the other dowel is backed-off so as not to interfere with the outer periphery of the cam member 116.

While only two dowels are illustrated in FIG. 3, those skilled in the art will readily appreciate that a plurality of dowels and corresponding dowel ports may be disposed between dowels 140*a* and 140*b* to define a range of positions for cam member 116. This will achieve a corresponding range of displacement flow conditions for the selectively adjustable fixed displacement vane pump 100.

As illustrated in FIG. 4, dowels 140*a*, 140*b* may be threadably mounted in bores formed in the wall of pump housing 112. Alternatively, as shown in FIG. 5, the dowels 140*a*, 140*b* may be configured as spring-loaded detents each supported in a sleeve 115 extending through bores formed in the wall of pump housing 112 and secured by a threaded end cap 117. In such an instance, the dowels would be spring biased into an engagement position with the outer surface of cam member 116. It is envisioned that other forms of dowels may be employed as well to selectively fix the eccentric position of the cam member relative to the rotor member.

Although the selectively adjustable fixed displacement vane pump of the subject invention is described with respect to preferred embodiments, those skilled in the art will readily appreciate that modifications and changes may be made thereto without departing from the spirit or scope of the subject invention as defined by the appended claims.

What is claimed is:

1. An adjustable fixed displacement vane pump comprising:

a) a pump housing defining an interior pumping chamber having a central axis extending therethrough;

b) a rotor member mounted for rotational movement within the interior pumping chamber of the pump housing about an axis aligned with the central axis of the interior pumping chamber, the rotor member having a central vane section with a plurality of circumferentially spaced apart radial vane slots formed therein, each vane slot supporting a corresponding vane element mounted for radial movement therein, and each vane element having an outer tip surface;

c) a cam member mounted for pivotal movement within the interior pumping chamber of the pump housing about a fulcrum axis extending parallel to the central axis of the rotor member, the cam member defining a cam body having a circular bore extending therethrough for receiving the rotor member, the circular bore forming a cam chamber defining a cam surface making continuous contact with the outer tip surfaces of the vane elements during the rotation of the rotor member; and d) at least two dowels supported within the pump housing and positioned to engage corresponding reception ports formed in an outer circumferential surface of the cam member to selectively maintain the cam member in a fixed position relative to the axis of the rotor member.

2. An adjustable fixed displacement vane pump as recited in claim 1, wherein the dowels are spring biased into an engagement position with the cam member.

3. An adjustable fixed displacement vane pump as recited in claim 1, wherein the dowels are adapted and configured to fix the position of the cam member between a maximum eccentric position relative to the axis of the rotor member corresponding to a maximum displacement flow condition for the pump and a minimum eccentric position relative to the axis of the rotor corresponding to a minimum displacement flow condition for the pump.

* * * * *